US009382049B2

(12) United States Patent
Kershner et al.

(10) Patent No.: US 9,382,049 B2
(45) Date of Patent: Jul. 5, 2016

(54) UPWARDLY BIASING CHILD-RESISTANT CLOSURE FOR LIQUID MEDICAMENTS

(71) Applicant: COMAR, INC., Buena, NJ (US)

(72) Inventors: David T. Kershner, Egg Harbor Township, NJ (US); David A. Manera, Buena, NJ (US); Michael Ruggieri, Pittsgrove, NJ (US); Kimberly A. Wargo, Vineland, NJ (US)

(73) Assignee: COMAR, LLC, Buena, NJ (US)

( * ) Notice: Subject to any disclaimer, the term of this patent is extended or adjusted under 35 U.S.C. 154(b) by 276 days.

(21) Appl. No.: 13/941,371

(22) Filed: Jul. 12, 2013

(65) Prior Publication Data

US 2014/0014612 A1 Jan. 16, 2014

Related U.S. Application Data

(60) Provisional application No. 61/671,313, filed on Jul. 13, 2012.

(51) Int. Cl.

| | |
|---|---|
| ***B65D 51/18*** | (2006.01) |
| ***B65D 50/04*** | (2006.01) |
| ***B65D 50/00*** | (2006.01) |
| ***B65D 41/26*** | (2006.01) |

(52) U.S. Cl.

CPC ..... *B65D 50/043* (2013.01); *B65D 41/26* (2013.01); *B65D 50/00* (2013.01); *B65D 50/041* (2013.01); *B65D 2251/0015* (2013.01); *B65D 2251/0087* (2013.01); *Y10T 29/49822* (2015.01); *Y10T 29/49826* (2015.01)

(58) Field of Classification Search

CPC ..... B65D 2251/0015; B65D 2251/0078; B65D 2251/06; B65D 41/04; B65D 41/06; B65D 41/065; B65D 41/0407; B65D 41/0421; B65D 41/0428; B65D 50/043; B65D 50/041; B65D 41/26; B65D 50/00; B65D 2251/0087; Y10T 29/49822; Y10T 29/49826

USPC ..... 215/209, 220, 228, 332; 220/254.8, 220/212, 259.3, 259.2, 259.4

See application file for complete search history.

(56) References Cited

U.S. PATENT DOCUMENTS

| | | | | |
|---|---|---|---|---|
| 4,834,251 | A | 5/1989 | Yu | |
| 4,883,192 | A * | 11/1989 | Krugman | 220/711 |
| 5,076,475 | A | 12/1991 | Dutt | |
| 5,088,632 | A | 2/1992 | Odet | |

(Continued)

OTHER PUBLICATIONS

International Search Report for PCT/US2013/050388.

(Continued)

*Primary Examiner* — James N Smalley

(74) *Attorney, Agent, or Firm* — James L. Gannon, II; Montgomery, McCracken, Walker & Rhoads, LLP

(57) ABSTRACT

A child-resistant closure for liquid medicaments consisting of two parts, a dosage cup and a bottle adapter. Dosage cup is configured to have cap lugs which reversibly engage helical locking lugs. In thread-on bottle adapter embodiments, helical locking lugs are located on the bottle adapter. In press-in bottle adapter embodiments, helical locking lugs are located on the neck finish of the bottle. A downward force is required to close the system, said force deforming a flexible shoulder, which in turn, creates an upwardly biasing force acting on the dosage cup to lock it in place in a child-resistant manner.

17 Claims, 7 Drawing Sheets

(56) References Cited

U.S. PATENT DOCUMENTS 5,316,161 A 5/1994 Gargione
5,975,322 A * 11/1999 Reid ..... B65D 41/0471 215/217
6,112,949 A * 9/2000 Rhodes et al. ..... 222/153.02
6,354,450 B1 3/2002 Zielinski
7,828,166 B1 * 11/2010 Sprick ..... 215/209
8,459,312 B2 6/2013 Manera

OTHER PUBLICATIONS

Written Opinion of the International Searching Authority for PCT/US2013/050388.

* cited by examiner

UPWARDLY BIASING CHILD-RESISTANT CLOSURE FOR LIQUID MEDICAMENTS

CROSS-REFERENCE TO RELATED APPLICATIONS

This application claims priority to U.S. Provisional Application 61/671,313 filed on Jul. 13, 2012, which is incorporated herein in its entirety.

FIELD OF THE INVENTION

The invention relates to improvements to child-resistant closures for dispensers of liquid medicaments, in particular dispensers of liquid medicaments, and thereby provides enhanced manufacturing capabilities by reducing the quantity of parts required to effect child-resistant closure coupled with dosage dispensers.

BACKGROUND OF THE INVENTION

Child-resistant closures for medicaments have been known in the art for nearly fifty years. These caps generally require two opposed movements acting at the same time to overcome the locking mechanism. For example, one type of cap requires a user to squeeze the cap at specific points, causing a deformation, and then to rotate the cap. If either the squeezing or rotating step is not performed, the cap cannot be opened. Another common method for imparting child-resistance on a cap is to require that the cap be pushed in a downward direction and then turned in order to be removed. Again, it can be seen that the two movements are opposed to one another; it is only through application of this unnatural combination of movements that the cap can be removed. Such a cap is disclosed in U.S. Pat. No. 5,316,161.

However, such closures also required a separate dosage cup to be manufactured and stored with the bottle and closure. This leads to increased manufacturing costs and well as an increased "storage cost" to the end user, as they are required to store an additional item. Further, there is a potential for the dosage caps to get lost as they were not securely affixed to the bottle and closure.

As a result, in light of the foregoing, it is clear that there is an unmet need in the art. The prior art closures fail to maximize the ease of both manufacture and storage of child-resistant closures for liquid medicaments. The present invention, through its unique combination of features, overcomes the problem and meets the need for providing compact closures for liquid medicaments which require fewer manufactured parts to permit access to the liquid medicament and provide for accurate measurement of the dispensed medicament while still maintaining a child-resistant closure assembly.

BRIEF SUMMARY OF THE INVENTION

The present invention provides a child-resistant closure capable of attachment to pre-existing, outwardly-threaded bottles of liquid medicaments, thus minimizing the quantity of components required to provide child-resistant closure and accurately dispense a liquid medicament.

One embodiment of the inventions provides for a two-piece closure utilizing an improved dosage cup to provide for child-resistant properties and a thread-on bottle adapter for affixing the closure to a preexisting bottle. The dosage cup is equipped with cap lugs which serve as a child-resistant mechanism and allow for fewer materials to be used, as a single-purpose child-resistant cap is replaced with the dual-purpose dosage cup.

An embodiment of the invention includes a flexible shoulder which provides an upward biasing force on the dosage cap, thus requiring a user to exert a downward force in conjunction with a rotational movement on the dosage cap. The need to couple a downward force with a rotational movement imparts a child-resistant quality to the system.

In one embodiment, the bottle adapter is configured with radially inwardly projecting lugs which prevent the closure from being removed from a bottle once attached. This provides an added benefit in that flow is permanently restricted, such that were a child to access the bottle once the cap was removed, the medicament would exit the bottle at a rate slower than that were the adapter not affixed.

Another embodiment of the invention provides for the bottle adapter to have radially inwardly projecting lugs which are positioned to permit the adapter to be removed from one bottle and placed on another. These lugs utilize a child-resistant technology, in that the adapter must be squeezed at points approximately perpendicular to the lugs in order to deform the adapter enough to permit the lugs to clear their counterparts on the neck face of the pre-existing bottle. This feature provides for the re-use of the adapter once the present bottle is empty, while still ensuring that access to the medicaments in a filled bottle are subject to flow restriction.

A series of embodiments of the invention relate to methods for attaching and removing the closure from a bottle containing liquid medicaments.

The final embodiment provides for a closure wherein the bottle adapter is of a press-in type.

Additional objects, advantages and novel features of the invention will be set forth in part in the description, examples and figures which follow, all of which are intended to be for illustrative purposes only, and not intended in any way to limit the invention, and in part will become apparent to those skilled in the art on examination of the following, or may be learned by practice of the invention.

BRIEF DESCRIPTION OF THE FIGURES

The foregoing summary, as well as the following detailed description of the invention, will be better understood when read in conjunction with the appended drawings. It should be understood, however, that the invention is not limited to the precise arrangements and instrumentalities shown.

DETAILED DESCRIPTION OF EXEMPLARY EMBODIMENTS OF THE INVENTION

For the purposes of the present disclosure, the term "helical lock grooves" shall be understood to mean either grooves or ridges configured to reversibly engage complementary lugs to provide for child-resistant closure. Such helical lock lugs and grooves are well known in the art, and similar lugs are described in, at least, U.S. Pat. No. 6,354,450.

The present invention may be constructed of any one of a number of polyolefins, including but not limited to polypropylene, as well as high-, medium-, and low-density polyethylene. These materials are known for their critical mechanical properties including, but not limited to, their flexural modulus, tensile strength, and elongation, and with the benefit of the present disclosure, one of ordinary skill in the art would understand that other materials exhibiting the same properties could be used in the construction of the cap, and therefore the invention is not limited to embodiments constructed of the materials listed above, but is intended to include all materials, whether presently known or developed in the future, which may exhibit similar structural properties.

Figure 1:
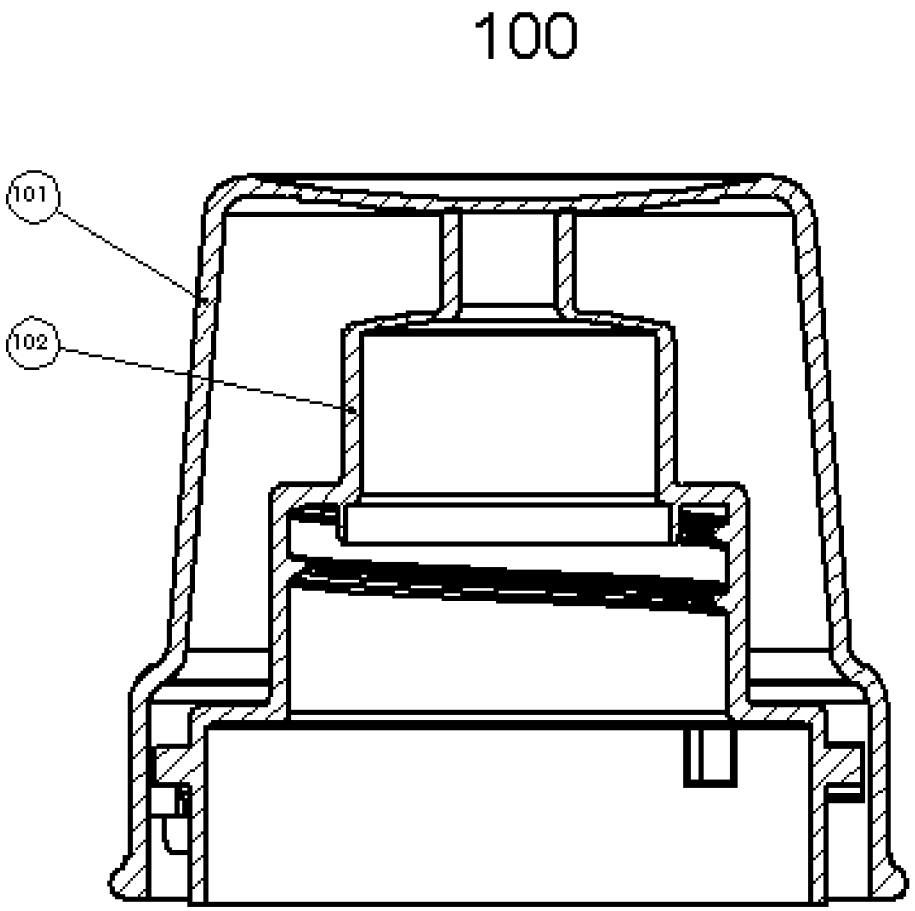
FIG. 1 shows a thread-on embodiment of the child-resistant closure.
Figure 2:
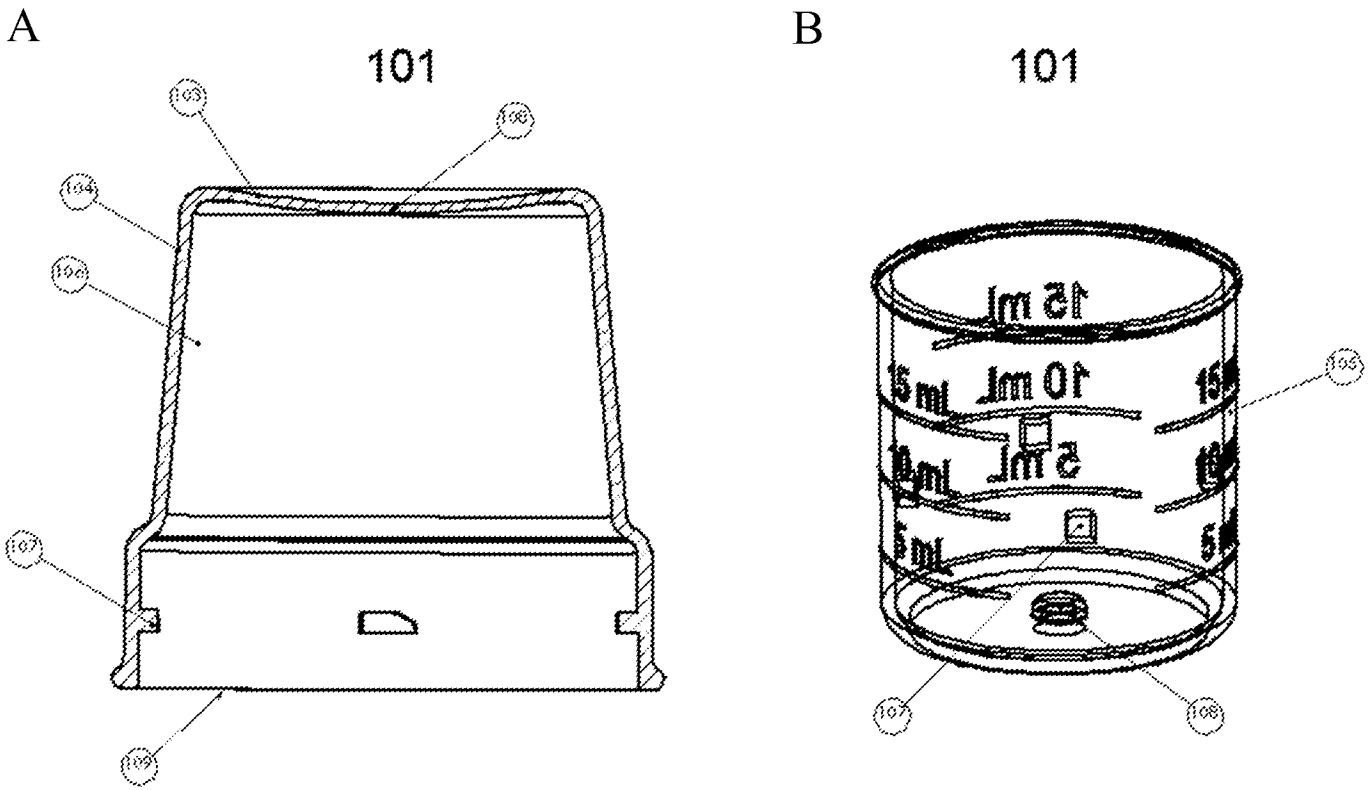
FIGS. 2A-2B show one embodiment of the dosage cup of the child-resistant closure in a cross-sectional view and another embodiment in full view.

Turning now to FIG. 1, it can be seen that closure 100 is comprised of dosage cup 101 and bottle adapter 102. In FIG. 2, the bottle adapter 102 is that of a thread-on type.

Dosage Cup

FIG. 2 shows alternative embodiments of dosage cup 101. FIG. 2A shows a cross-sectional view of one embodiment of dosage cup 101. This view depicts the cap 102 in an inverted position. FIG. 2B depics a full view of an alternative embodiment of the cap. In the Figure, the cap is oriented such that it is ready to receive liquid medicament.

As see in FIGS. 2A-2B, dosage cup 101 has a bottom portion 103 and a depending skirt 104. Both bottom portion 103 and depending skirt 104 have inner and outer surfaces. The inner surfaces of bottom portion 103 and depending skirt 104 define an inner chamber 106. In one embodiment, depending skirt 104 is constructed of a transparent material. In an alternative embodiment, both depending skirt 104 and bottom portion 103 are constructed of transparent materials. The transparent nature of depending skirt 104 permits a user to see the volume of liquid stored in the dosage cup when the cup has been inverted and filled.

The outer surface of depending skirt 104 includes a plurality of marked volumetric gradations 105. Volumetric gradations 105 are calculations of the volume of liquid stored in the dosage cup when the cup has been inverted, liquid has been added, and the level of the liquid meets the line of the volumetric gradation 105. In one embodiment, volumetric gradations 105 are etched into depending skirt 104. In an alternative embodiment, volumetric gradations 105 are off-set printed on the outer surface of depending skirt 104. In yet another alternative embodiment, volumetric gradations 105 are embossed onto depending skirt 104.

In one embodiment, volumetric gradations 105 are a linear mark and an adjacent textual indicator providing the numeric volume and the units of measure.

In an alternative embodiment, volumetric gradations 105 are a color-coded linear mark. In this embodiment, closure 100 or a kit containing closure 100 includes a reference chart identifying the color-coded gradation and an indication of the volume it represents.

Located on the inner surface of bottom portion 103 is protrusion 108. Protrusion 108 is located at the center of the inner surface of bottom portion 103 and extends along a central axis of the cylindrical shape created by depending skirt 104. Protrusion 108 serves several purposes. For example, protrusion provides for proper alignment of dosage cup 101 when dosage cup 101 is inverted and placed onto bottle adapter 102. Additionally, protrusion 108 also serves to partially seal a cylindrical stem 113 of bottle adapter 102 when dosage cup 101 has been inverted and secured to bottle adapter 102, as will be discussed later.

Dosage cup 101 has an open end 109 located distal to bottom portion 103. Open end 109 permits liquids to be poured into dosage cup 101 and also permits for dosage cup 101 to be inverted and placed on top of bottle adapter 102.

Because inner chamber 106 is defined in part by the inner surface of depending skirt 104, inner chamber has a perimeter. A plurality of radially inward projecting cap lugs 107 are mounted along a perimeter of inner chamber 106. Cap lugs 107 are constructed and configured to reversibly engage a plurality of helical lock grooves 116 located on thread-on embodiments of bottle adapter 102 or on the neck of a bottle utilizing a press-in type bottle adapter.

In one embodiment, depending skirt 104 has a constant diameter and therefore forms a cylinder of consistent diameter, extending from bottom portion 103 to open end 109. In this embodiment, the diameter of open end 109 is equivalent to the diameter of depending skirt 104.

In an alternative embodiment, the diameter of depending skirt 104 changes as depending skirt 104 extends from bottom portion 103 to open end 109. In one such embodiment, the diameters of open end 109 and depending skirt 104 at open end 109 are greater than a diameter the diameter of collection chamber 115 of bottle adapter 102, however the diameter of depending skirt 104 at bottom portion 103 is lesser than the diameter of collection chamber 115 of bottle adapter 102. In another such embodiment of changing diameter of depending skirt 104, diameters of open end 109 and depending skirt 104 at open end 109 are greater than the diameter of collection chamber 115 of bottle adapter 102; however, in this embodiment the diameter of depending skirt 104 at bottom portion 103 is greater than the diameter of collection chamber 115 of bottle adapter 102, yet lesser than the diameters of open end 109 and depending skirt 104 at open end 109.

Bottle Adapter

Bottle adapter 102 may be of a thread-on type or a press-in type.

Embodiments Wherein the Bottle Adapter is a Thread-on Type

Figure 3:
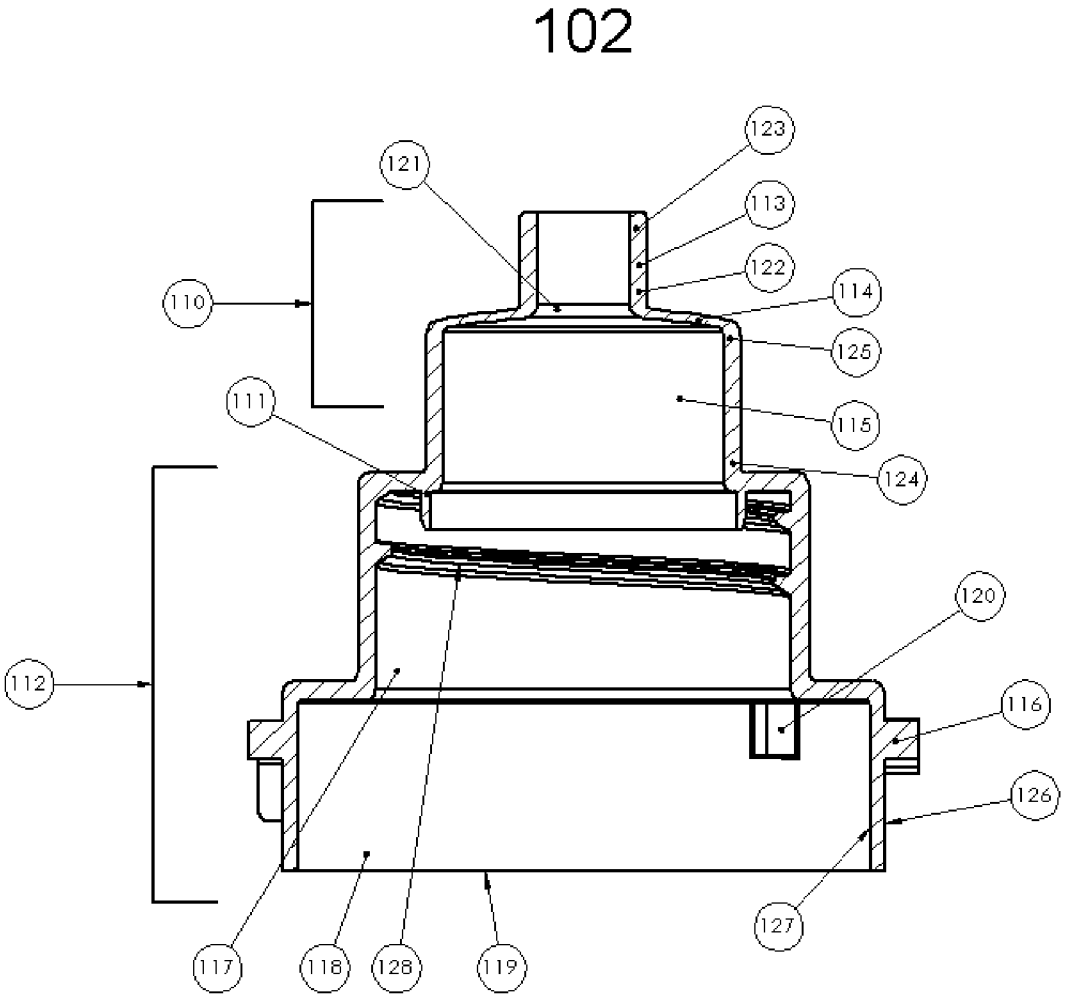
FIG. 3 shows a cross-sectional view of a thread-on embodiment of the bottle adapter of the child-resistant closure.

As seen in FIG. 3, bottle adapter 102 has a flow restrictor 110, a plug seal 111, and a threaded attachment collar 112. Flow restrictor 102 has a collection chamber 115, which is connected to a flexible shoulder 114, which is in turn connected to a cylindrical stem 113.

Cylindrical stem 113 is centrally located on flexible shoulder 114, and has two open ends: a first open end 122 proximal to flexible shoulder 114, and a second open end 123 distal to flexible shoulder 114. Cylindrical stem 113 has a central longitudinal axis. In one embodiment, cylindrical stem 113 is constructed of a rigid material. In another embodiment, cylindrical stem 113 is constructed of a material capable of deformation. In embodiments where cylindrical stem 113 is constructed of material capable of deformation, when dosage cup 101 is affixed to bottle adapter 102, pressure is exerted on cylindrical stem 113, causing cylindrical stem 113 to deform in such a manner that the internal diameter of cylindrical stem 113 decreases at one or more points between first open end 122 and second open end 123. This reduction in diameter decreases the rate at which liquid medicament would be able to (1) flow through cylindrical stem 113, (2) pool within the cavity defined by cylindrical stem 113, and (3) adhere to the inner surface of bottom portion 103 of dosage cup 101. By minimizing the amount of liquid medicament which adheres to the inner surface of dosage cup 101, the present invention further protects against accidental overdose by ingestion of large quantities of medicament, in that should a large quantity of liquid medicament adhere to the inner surface of bottom portion 103 when the bottle is inverted, there is the potential that when the cap is removed, residual liquid medicament would remain in the cap, and a child would only need access to the cap, not to the bottle itself, in order to ingest a portion of liquid medicament. In one embodiment, cylindrical stem 113 is of a uniform diameter. In another embodiment, cylindrical stem 113 has at least two different diameters; such multi-diameter cylindrical stems may be manifested by a two-piece cylindrical stem, or a one-piece, stepped cylindrical stem, or by any other method known to those skilled in the art.

Figure 4:
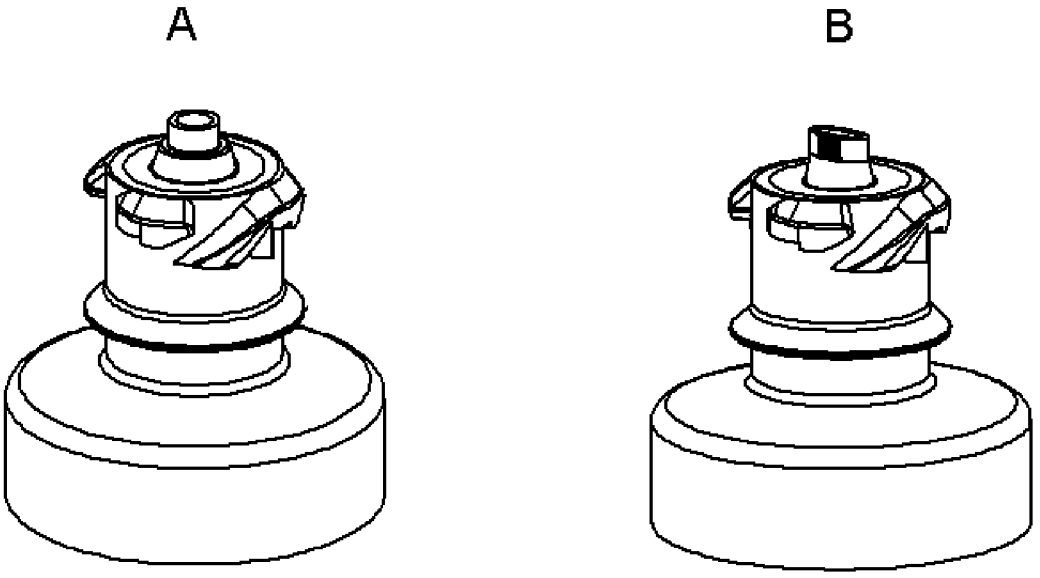
FIGS. 4A-4B show embodiments of the closure which include a pinch valve, first in the resting, closed position and then in the open position.

In an alternative embodiment, shown in FIGS. 4A-4B, second open end 123 of cylindrical stem 113 includes a valve to restrict the flow of liquid medicament. In one such alternative embodiment seen in FIG. 4, the valve is a pinch-valve, said pinch valve having a closed position and an open position. The pinch valve normally resides in a resting, closed position, as shown in FIG. 4A, and may only be transitioned to the open position when acted upon in a specific, deliberate fashion. In one such embodiment, the specific, deliberate action required to operatively transition the pinch valve from its resting, closed position to its open position is the application of a pinching force applied along a diameter of the valve, such that a deformation of the valve occurs, resulting into movement to the open position, wherein liquid medicaments are able to flow freely through the valve. This open position is depicted in FIG. 4B. Once the pinching force ceases to be applied, the resilience of the materials used in the construction of the valve cause the valve to return to its resting, closed position.

Turning back to FIG. 3, flexible shoulder 114 has a central port 121, aligned with first open end 122 of cylindrical stem 113 and configured to permit the passage of fluid from collection chamber 115 through central port 121, into cylindrical stem 113 via first open end 122, and then out of cylindrical stem 113 via second open end 123. Flexible shoulder 114 is constructed of a material which permits deformation or flexion. As such, flexible shoulder 114 has at least two positions: a resting position and a stressed position. When in its resting position, flexible shoulder 114 maintains a planar horizontal conformation, as seen in FIG. 5A. This is the position and conformation of flexible shoulder 114 when no forces are exerted upon it. When a downward force is applied to flexible shoulder 114, flexible shoulder 114 deforms or flexes in a downward direction. This position is known as the stressed position. When in the stressed position, flexible shoulder 114 takes on a concave conformation, as seen in FIG. 5B. Flexible shoulder 114 is constructed of a resilient material. This resiliency enables flexible shoulder 114 to return to its resting position when a downward force ceases to be applied to flexile shoulder 114, such as when the cap has been removed, as depicted in FIG. 5C.

Figure 5:
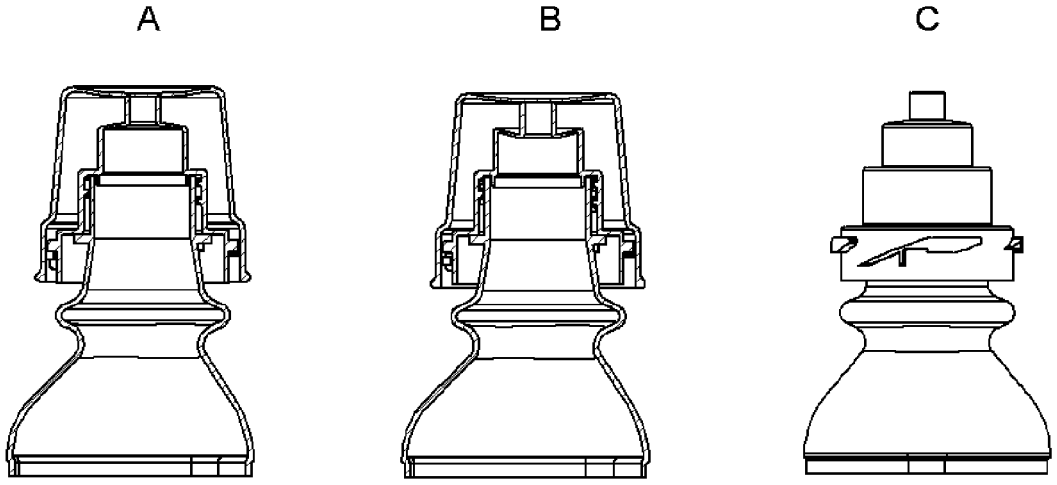
FIGS. 5A-5C show the manner in which the flexible shoulder deforms under pressure in embodiments utilizing a thread-on adapter.

Additionally, the resilience of the materials used in the construction of flexible shoulder 114 enables flexible shoulder 114 to exert an opposite, upward force on any object exerting a downward force on it. As such, in the present invention, when dosage cup 101 is inverted and placed on top of bottle adapter 102, any downward force applied to dosage cup 101 is transferred to flexible shoulder 114. This downward force will cause flexible shoulder 114 to be deformed in the downward direction, however the resilience of the materials used in the construction of flexible shoulder 114 will exert an upward force on cylindrical stem 113, which is in turn, transferred to dosage cup 101. As a result, when dosage cup 101 has been inverted and attached to bottle adapter 102 via engagement of the plurality of helical lock grooves 116 by the plurality of cap lugs 107, a downward force is exerted on flexible shoulder 114 by dosage cup 101 via cylindrical stem 113, as shown in FIG. 5. Flexible shoulder 114 has therefore been deformed into its stressed position, and as a result, a corresponding upward biasing force is exerted on dosage cup 101 by flexible shoulder 114 via cylindrical stem 113. This upward biasing force causes the plurality of cap lugs 107 to engage the plurality of helical lock grooves 116 in a child resistant manner, as a downward force must be exerted on dosage cup 101 to permit the plurality of cap lugs 107 to clear the complementary portions of helical lock grooves 116 and this downward force must further be coupled with a rotational movement of dosage cup 101 in order to fully disengage cap lugs 107 from helical lock grooves 116. The upward biasing force exerted on dosage cup 101 by flexible shoulder 114 via cylindrical stem 113 creates a seal between second end 123 of cylindrical stem 113 and the inner surface of bottom portion 103. In one embodiment, the seal created is the primary seal for the system.

As can be seen in FIG. 3, collection chamber 115 has a generally cylindrical shape. The cylindrical shape of collection chamber 115 has a central longitudinal axis. In one embodiment, the central longitudinal axis of collection chamber 115 is shared by cylindrical stem 113. In an alternative embodiment, the central longitudinal axis of cylindrical stem 113 is off-set from the central cylindrical axis of collection chamber 115. Collection chamber 115 is constructed of a rigid material. Collection chamber 115 has a first end 124 which is connected to plug seal 111 and a second end 125 which is connected to flexible shoulder 114. First end 124 of collection chamber 115 is open and is configured to permit liquid medicament to flow out of the pre-existing bottle, through plug seal 111 and into collection chamber 115.

Plug seal 111 is connected to flow restrictor 110 and threaded attachment collar 112 and serves as transition point between the two. Plug seal 111 has an aperture to permit liquid medicament to pass from a pre-existing bottle into collection chamber 115. Plug seal 111 is one of any number of plug seals known in the art capable of ensuring that all liquid medicament exiting the bottle is force to proceed in a direction such that liquid medicament first exits an internal cavity of the bottle, then proceeds into collection chamber 115, next exits collection chamber 115 and proceeds into cylindrical stem 113, and finally exits cylindrical stem 113 at second end 123. That is to say, liquid medicament does not travel down an internal surface of threaded attachment collar 112. Plug seal 111 therefore serves to provide a leak-free seal or leak-free fit for bottle adapter 102 when it is affixed to a bottle.

Threaded attachment collar 112 has an outer surface 126 and an inner surface 127. Outer surface 126 of threaded attachment collar has a plurality of helical lock grooves which are configured to reversible engage cap lugs 107 in a complementary manner Inner surface 127 has a threaded upper portion 117 and an unthreaded lower portion 118. Threaded upper portion 117 is configured with a plurality threads 128 capable of reversibly engaging a plurality of complementary threads located on a bottle of liquid medicaments. Threaded upper portion 117 has a diameter. Unthreaded lower portion 118 is has a bottom opening 119 and a plurality of radially inwardly projecting locking lugs 120. Locking lugs are configured to engage a plurality of complementary locking lugs located on a bottle of liquid medicaments. Additionally, unthreaded lower portion 118 has a diameter. In one embodiment, the diameter of threaded upper portion 117 is equivalent to the diameter of unthreaded lower portion 118. In an alternative embodiment, the diameter of unthreaded lower portion 118 is greater than the diameter of threaded upper portion 117.

In one embodiment, the plurality of locking lugs 120 is located along bottom opening 119. In such an embodiment, unthreaded lower portion 118 is constructed of a material capable of deformation when pressure by a user is exerted upon it. In these embodiments, by squeezing unthreaded lower portion 118 at locations perpendicular to the plurality of locking lugs 120, unthreaded lower portion 118 is deformed in a direction which moves the plurality of locking lugs 120 radially outward from a central longitudinal axis of unthreaded lower portion 118. Such deformation permits reversible engage of complementary lugs on a bottle by locking lugs 120, resulting in the ability to use closure 100 on more than one bottle by simply squeezing unthreaded lower portion 118 at locations perpendicular to the plurality of locking lugs 120 and disengaging the plurality of locking lugs 120 from a plurality of complementary lugs on a first bottle, and then attaching bottle adapter 102 to a new bottle bearing the appropriate threads and complementary lugs.

In an alternative embodiment, the plurality of locking lugs 120 is located a distance upward from bottom opening 119. In such an embodiment, deformation of unthreaded lower portion 118 is not possible. As such, once bottle adapter 102 has been attached to a bottle with appropriate threads and complementary lugs, the plurality of locking lugs 120 cannot be disengaged, and therefore bottle adapter cannot be removed from the bottle.

Figure 6:
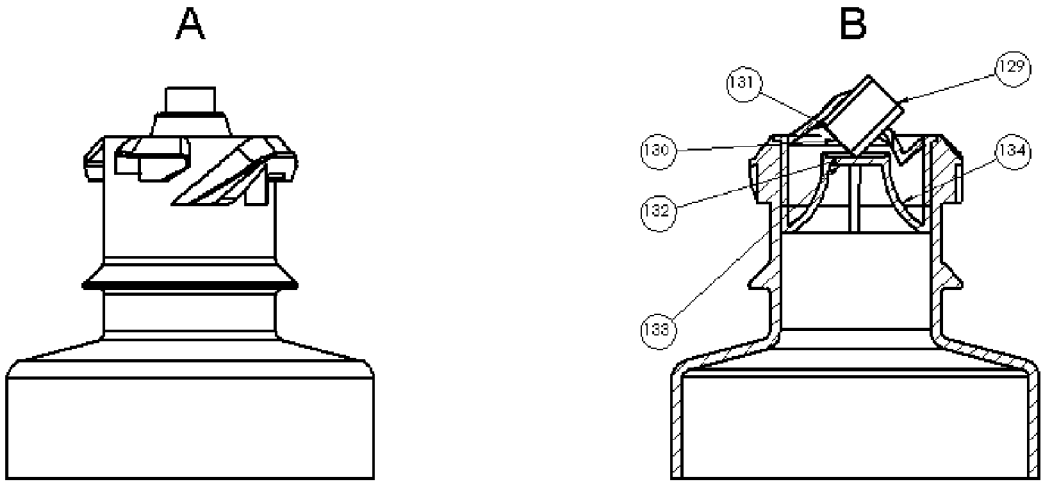
FIGS. 6A-6B depict the use of an off-set valve in an additional embodiment of the invention.

In an alternative series of embodiments embodiment, bottle adapter 102 further includes an off-set valve. Although FIGS. 6A-6B depict a press-in adapter, the concepts are applicable to both thread-on and press-in adapters. In one off-set valve embodiment, the off-set valve has an internal hollow extension which is connected to cylindrical stem 113, as can be seen in FIG. 6A and FIG. 6B. In one embodiment, internal hollow extension extends in a downward direction from cylindrical stem 113, whereas in an alternative embodiment, internal hollow extension extends fully through cylindrical stem 113 such that a top end of internal hollow extension 129 is outside of bottle adapter 102 and a bottom end of internal hollow extension is inside bottle adapter 102. In all off-set valve embodiments, internal hollow extension 129 has a bottom end 130 terminating in a bottom edge 131. Additionally, in all off-set valve embodiments, the valve has a flow-restricting platform 132 positioned beneath the extension. Flow restricting platform 132 has a central portion 133 which is solid and impermeable to liquid. In one embodiment, central portion 133 of platform is connected to an interior surface of bottle adapter 102 by a series of arms 134 extending beneath and radially outward from flow-restricting platform 132. In an alternative embodiment, flow-restricting platform 132 is comprised of a solid, impermeable central portion 133 as described above, however this central portion is surrounded by a series of ports which permit the flow of liquid medicament from one side of flow-restricting platform to the other.

Operation of the above-described off-set valve is as follows: in its closed state, the internal hollow extension 129 is aligned with a shared central longitudinal axis of the bottle and the cylindrical stem 113, such alignment being perpendicular to the horizontal plane occupied by the central portion 133 of flow-restricting platform 132. This position is shown in full-view by FIG. 6A. In this position, bottom edge 131 of internal hollow extension 129 rests squarely on central portion 133 and forms a seal therewith. As a result, liquid medicament is prevented from entering cylindrical stem 113 even when the bottle is inverted. To operatively engage the off-set valve and transition to the open state of the valve, cylindrical stem 113, and therefore, internal hollow extension 129, are pivoted such that a central longitudinal axis shared by cylindrical stem 113 and internal hollow extension 129 is no longer aligned with the central longitudinal axis of the bottle. This is shown in a cross-sectional view in FIG. 6B. As a result, bottom edge 131 of internal hollow extension 129 is no longer squarely resting on central portion 133. Therefore, the seal previously created by the connection of these two structures is no longer present, and fluid may freely pass through internal hollow extension 129 and cylindrical stem 113 in a controlled manner.

The off-set valve may be returned to its closed state simply by pivoting cylindrical stem 113 and internal hollow extension 129 in the opposite direction, until their shared central longitudinal axis is once again aligned with the central longitudinal axis of the bottle, and the bottom edge 131 of internal hollow extension 129 has squarely engaged central portion 133, creating a seal. The pivoting actions described above will impart a downward force upon central portion 133, therefore it is critical that the manner in which central portion 133 is connected to an interior surface of bottle adapter 102 provide the ability for slight downward movement of central portion 133. In one embodiment, the series of arms 134 extending beneath and radially outward from flow-restricting platform 132 may be constructed of a resilient material which permits flexion of the arms 134, resulting in a vertical movement of flow-restricting platform 132. In an alternative embodiment, the outer portions of flow restricting platform 132 connect to an internal surface of bottle adapter 102 and are constructed of a resilient material which is capable of extension when a force is applied thereto, thus permitting the required downward movement of central portion 133 of flow-restricting platform. The ability of central portion 133 to travel in a downward direction is also critical to the ability of the bottle adapter 102 to engage dosage cup 101 in these embodiments. When the downward force is transferred from dosage cup 101 to cylindrical stem 113, part of this downward force is transferred to flexible shoulder 114 and part of this force is transferred to central portion 133 via the internal hollow extension and its connection to cylindrical stem 113. As a result, central portion 133 must be capable of traveling in a downward direction in order to permit dosage cup 101 to be attached to bottle adapter 102.

Embodiments Wherein the Bottle Adapter is a Press-In Adapter

Although the foregoing has described a bottle adapter as being a device which threads onto a pre-existing bottle, the present invention is not so limited. Embodiments of the present invention wherein the bottle adapter is a press-in bottle adapter are also contemplated. In all such embodiments, the neck finish of the described bottle has helical lock grooves configured to reversibly engage the cap lugs of dosage cup 101.

Adapters which press into the neck of a bottle instead of threading onto the neck finish of a bottle are known in the art and have been described in, among others, U.S. Pat. No. 8,459,312. The present invention advantageously improves upon prior bottle adapters by providing for the inclusion of the above-mentioned flow restrictor 110 comprising at least cylindrical stem 113 and flexible shoulder 114. Alternative embodiments also include additional structures recited in the above description where bottle adapters were previously of a thread-on type.

In all embodiments wherein the bottle adapter is of a press-in type, the adapter has: (1) a flow restrictor comprising at least cylindrical stem 113 and flexible shoulder 114, (2) a rigid shoulder, and (3) a lower body.

Figure 7:
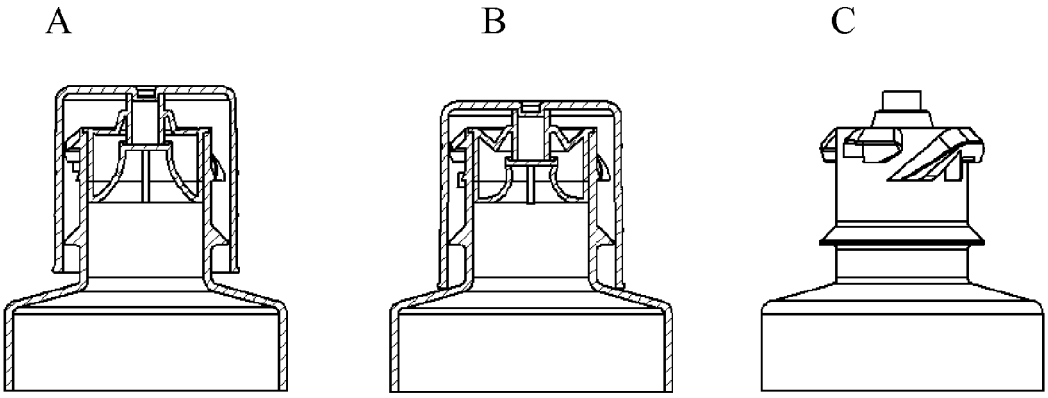
FIGS. 7A-7C depict the manner in which the flexible shoulder deforms under pressure in embodiments utilizing a press-in adapter.

In embodiments where the bottle adapters are of a press-in type, both cylindrical stem 113 and flexible shoulder 114 are present and function as described above. This can be seen in FIGS. 7A-C, which depict the press-in equivalent of FIGS. 5A-5C. All embodiments and features of cylindrical stem 113 as disclosed above with regard to thread-on bottle adapters are applicable to press-in bottle adapters and are therefore herein incorporated by reference and applied to any press-in bottle adapter embodiment of the present invention. Similarly all functions and features of flexible shoulder 114 as it relates to cylindrical stem 113 as disclosed above with regard to thread-on bottle adapters are applicable to press-in bottle adapters and are therefore herein incorporated by reference and applied to any press-in bottle adapter embodiment of the present invention.

In one embodiment wherein the bottle adapter is a press-in bottle adapter, the bottle adapter further includes a collection chamber as disclosed above. All functions and features of the collection chamber as they relate to cylindrical stem 113 and flexible shoulder 114 as described above in embodiments wherein the bottle adapter is of a thread-on type are applicable to the present embodiment and are therefore herein incorporated by reference and applied to the present embodiment In one embodiment, the press-in bottle adapter has a rigid shoulder which, when the bottle adapter has been fully inserted, rests on top of, and therefore above, an upper edge of the neck of the bottle. In an alternative embodiment, the rigid shoulder of the bottle adapter rests within, and flush with, an upper edge of the neck of the bottle. Such flush-resting embodiments provide for increased safety, as they are difficult for children to remove.

In embodiments wherein the bottle adapter does not include a collection chamber, the flexible shoulder is connected directly to the rigid shoulder. In embodiments wherein the bottle adapter does include a collection chamber, the flexible stem is connected to the collection chamber, which is, in turn, connected to the rigid shoulder.

In all embodiments, the rigid shoulder is connected to a lower body. Lower body is configured to be inserted into and fit snugly within the neck of a bottle, providing a leak-free fit. Such means and methods of providing a leak-free fit are well known in the art and may include ridges, o-rings, among others. The present disclosure is not limited to these instrumentalities, and with the benefit of the present disclosure, one skilled in the art would be enabled to use a variety of methods or structures to create such a leak-free fit.

In one series of embodiments, the bottle adapter further includes an off-set valve as described above. All features of the off-set valve as described above with respect to a thread-on type bottle adapter are applicable to press-in type bottle adapters and are therefore herein herein incorporated by reference.

Methods of Use

A method for affixing a thread-on bottle adapter to a bottle having outer threads and a plurality of radially-outwardly projecting locking lugs is as follows: First, bottle adapter 102 is positioned on top of the threaded bottle. Then a rotational movement is applied to bottle adapter 102 until threaded attachment collar 112 engages the threads of the bottle. As the rotational movement continues to be applied, threads 128 of bottle adapter 102 further engage the threads of the bottle. As threads 128 of bottle adapter 102 engage the threads of the bottle, so, too, will radially-inwardly projecting locking lugs 120 of bottle adapter 102 engage the radially outwardly projecting locking lugs of the bottle. Once threads 128 of bottle adapter 102 have fully engaged the threads of the bottle and locking lugs 120 of bottle adapter 102 have engaged the locking lugs of the bottle, application of the rotational movement to bottle adapter 102 ceases. This method can carried out with dosage cup 101 attached to bottle adapter 102 or with dosage cup 101 separated from bottle adapter 102.

The method for attaching dosage cup 101 to a thread-on bottle adapter is as follows: First, the dosage cup 101 is inverted and positioned above bottle adapter 102. Then, dosage cup 101 is lowered until protrusion 108 nests within second open end 123 of cylindrical stem 113. Next, a downward force is applied to dosage cup 101 to deform flexible shoulder 114 in a downward direction. Then a rotational movement is applied to dosage cup 101 to permit the plurality of cap lugs 107 to engage helical lock grooves 116 of the bottle adapter. The steps of this method can be performed when the bottle adapter is attached to a bottle or when it is separated from a bottle. In an alternative embodiment, no downward force is directly exerted on the cap by a user. Instead, continued rotational movement of dosage cup 101 once the helical lugs are engaged creates a downward movement exerted through operation of the decline of the grooves as a simple machine.

One method for attaching the closure to a bottle having outer threads and a plurality of radially outwardly projecting locking lugs is to perform the steps of applying a thread-on bottle adapter to the bottle and then to perform the steps of applying the dosage cup to a thread-on bottle adapter.

An alternative method for attaching the closure to a bottle having outer threads and a plurality of radially outwardly projecting locking lugs is to perform the steps of applying the dosage cup to a thread-on bottle adapter and then to perform the steps of applying the thread on bottle adapter to a bottle.

A method for affixing a press-in bottle adapter embodiment of the closure to a bottle having a plurality of helical lock grooves on its neck finish is as follows: first the bottle adapter is inserted into the neck of the bottle. Next, the dosage cup 101 is inverted and positioned above the press-in embodiment of the bottle adapter. Then, dosage cup 101 is lowered until protrusion 108 nests within second open end 123 of cylindrical stem 113. Next, a downward force is applied to dosage cup 101 to deform flexible shoulder 114 in a downward direction. Then a rotational movement is applied to the dosage cup to permit the plurality of cap lugs 107 to engage helical lock grooves on the neck finish of the bottle. In an alternative embodiment, no downward force is directly exerted on the cap by a user. Instead, continued rotational movement of dosage cup 101 once the helical lugs are engaged creates a downward movement exerted through operation of the decline of the grooves as a simple machine.

A method for removing dosage cup 101 from a thread-on bottle adapter embodiment of the invention is as follows: first a downward force is applied on to the dosage cup to deform the flexible shoulder in a downward direction. This downward force permits the cap lugs 107 to disengage the helical lock grooves of the bottle adapter. A rotational force is then applied to dosage cup 101 to permit the plurality of cap lugs to clear the plurality of helical lock grooves. The cap is then lifted away from the bottle adapter.

A method for removing dosage cup 101 from a press-in bottle adapter embodiment of the invention is as follows: first a downward force is applied to dosage cup 101 to deform flexible shoulder 114 in a downward direction. This downward force permits cap lugs 107 to disengage the helical lock grooves on the neck finish of the bottle. A rotational force is then applied to dosage cup 101 to permit the plurality of cap lugs to clear the plurality of helical lock grooves. The cap is then lifted away from the bottle adapter.

A method for removing a thread-on bottle adapter embodiment of the present invention from a bottle having outer threads and a plurality of radially-outwardly projecting locking lugs is as follows: first an inward compressive force is applied to unthreaded lower portion 118 at points perpendicular to the plurality of radially-inwardly projecting locking lugs 120. This compressive force is continually applied until unthreaded lower portion 118 deforms in an amount sufficient to permit the plurality of radially-inwardly projecting locking lugs 120 to move radially outward from a central longitudinal axis of bottle adapter 102 a distance capable of permitting the radially—inwardly projecting locking lugs 120 to clear the plurality of radially-outwardly projecting locking lugs. A rotational movement is then applied to unthreaded lower portion 118 while the compressive force is maintained. One then continues to simultaneously apply the compressive force and the rotational movement until radially-inwardly projecting locking lugs 120 have cleared the plurality of radially-outwardly projecting locking lugs of the bottle. By continuing to apply a rotational movement to the unthreaded lower portion 118, threaded upper portion 117 is permitted to disengage the threads of the bottle. Once the threads of the bottle have been fully disengaged, closure 100 may be lifted away from the bottle. In on embodiment, once plurality of radially-inwardly projecting locking lugs 120 have cleared the radially-outwardly projecting locking lugs, the compressive force is no longer applied. In another embodiment, the compressive force continues to be applied until closure 100 has been lifted away from the bottle.

The disclosure of each patent, patent application and publication cited or described in this document is hereby incorporated herein by reference, in its entirety.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims.

We claim:

1. A two-piece, child-resistant closure device for dispensers of liquid medicaments, the closure device comprising:

a dosage cup having a bottom portion having an inner surface and an outer surface, a depending skirt having an inner surface and an outer surface, a plurality of volumetric gradations on the outer surface of the depending skirt, an inner chamber defined by the inner surfaces of the bottom portion and the depending skirt, a plurality of radially inward projecting cap lugs mounted on a perimeter of the inner chamber, and a protrusion on the inner surface of the bottom portion, an open end; and a thread-on bottle adapter having a flow restrictor having a centrally located cylindrical stem, a flexible shoulder with a horizontal resting position and capable of being deformed downward into a stressed position, and a collection chamber, a plug seal, and a threaded attachment collar with an outer surface having a plurality of helical lock grooves complementary to the plurality of cap lugs, an inner surface having a threaded upper portion, and an unthreaded lower portion, the closure device configured such that upon engagement of the radially inward projecting cap lugs with the plurality of helical lock grooves, the protrusion contacts the thread-on bottle adapter.

2. The child-resistant closure device of claim 1, wherein the threaded upper portion has a diameter.

3. The child-resistant closure device of claim 2, wherein the unthreaded lower portion has a diameter greater than the diameter of the threaded upper portion.

4. The child-resistant closure device of claim 1, wherein the unthreaded lower portion further comprises a bottom opening and a plurality of radially inwardly projecting locking lugs.

5. The child-resistant closure device of claim 4, wherein the plurality of radially inwardly projecting locking lugs is located along the bottom opening.

6. A method for removing the child-resistant closure of claim 5 from a bottle having outer threads and a plurality of radially-outwardly projecting locking lugs, the method comprising:

applying an inward compressive force to the unthreaded lower portion at points perpendicular to plurality of radially-inwardly projecting locking lugs, continuing to apply the inward compressive force until the unthreaded lower portion deforms in an amount sufficient to permit the plurality of radially-inwardly projecting locking lugs to clear the plurality of radially-outwardly projecting locking lugs, applying a rotational movement to the unthreaded lower portion while maintaining an inward compressive force, continuing to apply the rotational movement and inward compressive force until the plurality of radially-inwardly projecting locking lugs has cleared the plurality of radially-outwardly projecting locking lugs, permitting the threaded upper portion to disengage the outer threads of the bottle, and lifting the closure away from the bottle.

7. The method of claim 6, further comprising ceasing to apply an inward pressure once the plurality of radially-inwardly projecting locking lugs has cleared the plurality of radially outwardly projecting locking lugs.

8. The child-resistant closure device of claim 4, wherein the plurality of radially inwardly projecting locking lugs is located a distance upward from the bottom opening.

9. A method for affixing the child-resistant closure of claim 4 to a bottle of liquid medicaments having outer threads and a plurality of radially-outward projecting locking lugs, the method comprising:

positioning the bottle adapter on top of the outwardly-threaded bottle, applying a rotational movement upon the bottle adapter until the threaded attachment collar engages the outer threads, and continuing to apply the rotational movement until the threaded attachment collar has fully engaged the outer threads and the plurality of radially-inwardly projecting locking lugs has engaged the plurality of radially-outwardly projecting locking lugs.

10. The method of claim 9, further comprising positioning the dosage cup in an inverted position over the bottle adapter, applying a downward force on the dosage cup to deform the flexible shoulder in a downward direction, applying a rotational movement upon the dosage cup until the plurality of cap lugs engage the plurality of helical lock grooves, releasing the downward force on the dosage cup.

11. A method for removing the dosage cup from the child resistant closure of claim 4, comprising:

applying a downward force on the dosage cup to deform the flexible shoulder in a downward direction, applying a rotational force on the dosage cup to permit the plurality of cap lugs to clear the plurality of helical lock grooves.

12. A system for providing child-resistant closure of a bottle of liquid medicaments the system comprising:

a dosage cup for sealing the system and measuring liquid medicaments dispensed from the bottle, the dosage cup having a plurality of radially inward projecting cap lugs and a bottom portion with a protrusion, and a thread-on bottle adapter for restricting the flow of the medicaments dispensed from the bottle, the thread-on bottle adapter having a flow restrictor with a centrally located cylindrical stem, a flexible shoulder with a horizontal resting position and capable of being deformed downward into a stressed position, and a threaded attachment collar having a plurality of helical lock grooves for reversibly engaging the plurality of cap lugs, the system configured such that upon engagement of the cap lugs with the plurality of helical lock grooves, the protrusion contacts the thread-on bottle adapter.

13. The system of claim 12, wherein when the plurality of cap lugs has engaged the plurality of helical lock grooves the flexible shoulder is deformed downward into a stressed position.

14. The system of claim 13, wherein when the flexible shoulder is deformed downward into a stressed position, it exerts an upward biasing force on the dosage cup.

15. The system of claim 14, wherein the upward biasing force exerted on the dosage cup creates a child-resistant property for the system.

16. The system of claim 14, wherein the upward biasing force exerted on the dosage cup creates a primary seal for the system.

17. A two-piece, child-resistant closure device for dispensers of liquid medicaments, the closure device comprising:

a dosage cup having a bottom portion having an inner surface and an outer surface, a depending skirt having an inner surface and an outer surface, a plurality of volumetric gradations on the outer surface of the depending skirt, an inner chamber defined by the inner surfaces of the bottom portion and the depending skirt, a plurality of radially inward projecting cap lugs mounted on a perimeter of the inner chamber, and a protrusion on the inner surface of the bottom portion, an open end; and a press-in bottle adapter having a flow restrictor, the flow restrictor having a cylindrical stem and a flexible shoulder with a horizontal resting position and capable of being deformed downward into a stressed position, a rigid shoulder, and a lower body, the closure device configured such that upon engagement of the radially inward projecting cap lugs with a plurality of helical lock grooves on a neck finish of a bottle, the protrusion contacts the press-in bottle adapter.

* * * * *